United States Patent [19]

Mazdiyasni

[11] 4,043,377

[45] Aug. 23, 1977

[54] METHOD FOR CASTING METAL ALLOYS

[75] Inventor: Khodabakhsh S. Mazdiyasni, Xenia, Ohio

[73] Assignee: The United States of America as represented by the Secretary of the Air Force, Washington, D.C.

[21] Appl. No.: 716,303

[22] Filed: Aug. 20, 1976

[51] Int. Cl.[2] ..... B22C 3/00; B22C 9/10

[52] U.S. Cl. ..... 164/7; 164/14; 164/37; 164/41; 164/61; 164/132; 164/138; 427/133

[58] Field of Search ..... 164/138, 61, 132, 7, 164/14, 37, 41; 427/133, 134, 135

[56] References Cited

U.S. PATENT DOCUMENTS

| | | | |
|---|---|---|---|
| 3,537,949 | 11/1970 | Brown et al. | 164/138 X |
| 3,727,666 | 4/1973 | Vander Sluis | 427/135 X |
| 3,850,624 | 11/1974 | Hulit et al. | 164/61 X |
| 3,957,104 | 5/1976 | Terpay | 164/132 |

FOREIGN PATENT DOCUMENTS

| | | | |
|---|---|---|---|
| 745,037 | 2/1956 | United Kingdom | 164/138 |

*Primary Examiner*—Ronald J. Shore
*Attorney, Agent, or Firm*—Joseph E. Rusz; Cedric H. Kuhn

[57] ABSTRACT

In a method for casting metal alloys, a molten metal alloy is introduced into a mold of a desired configuration containing a core material fabricated to a desired shape from titanium nitride while maintaining the mold under a vacuum. After allowing the mold to cool slowly to room temperature, the casted metal alloy with the core material exposed at one end is removed from the mold and immersed in a boiling caustic solution, thereby causing the titanium nitride core material to decompose. The casting so obtained has a smooth inner surface, an indication that no chemical reactions have occurred between the alloy and the core material.

11 Claims, No Drawings

METHOD FOR CASTING METAL ALLOYS

RIGHTS OF THE GOVERNMENT

The invention described herein may be manufactured and used by or for the Government of the United States for all governmental purposes without the payment of any royalty.

FIELD OF THE INVENTION

This invention relates to a method of casting metal alloys, utilizing a non-silicious, leachable core material.

BACKGROUND OF THE INVENTION

A number of materials have been suggested for use as a core material in casting hollow objects or articles having passageways or openings formed therein. One requirement of a suitable core material is that it be readily removable from the casted article. Another requirement is that the core material be non-reactive with the casting materials. Examples of core materials that have been used include sand, glass, salt, carbon, thin walled metal shells, and ceramics.

Recent developments in the metal alloy and casting arts have rendered obsolete the prior art core materials. For example, directionally solidified cast turbine blades made fom eutectic composition nickel base superalloys are the leading candidates for withstanding engine operating conditions in advanced gas turbine engines. Since these blades must be air cooled, they must be fabricated with internal cooling passages. Normally, this is accomplished by casting the molten metal alloy around a ceramic core which is composed of a material inert to the molten alloy. Because the directional solidification of eutectic alloys requires the core body to be exposed for longer periods of time to higher temperatures than previously encountered in casting turbine blades, commercial core materials currently available are unsatisfactory. The lack of a suitable core material is impeding the development of a production process for manufacturing cooled turbine blades from eutectic alloys with aligned microstructures. This in turn limits the temperature capability of the blades, the turbine inlet temperatures, and ultimately the improvement in performance of advanced engines.

It is an object of this invention to provide a method for casting hollow articles, utilizing titanium nitride as the core material.

Another object of the invention is to provide a method for casting superalloys and directionally solidified eutectic alloys in which a non-silicious, leachable core material is employed.

Other objects and advantages of the invention will become apparent to those skilled in the art upon consideration of the accompanying disclosure.

SUMMARY OF THE INVENTION

The present invention lies in a method for casting metal alloys in which a molten alloy is introduced into a mold containing a core body or structure fabricated from titanium nitride, and preferably having a yttrium oxide coating, while maintaining the mold under a vacuum. After allowing the mold to cool slowly to room temperature while under a vacuum, the casted article with an end of the core body exposed is removed from the mold and placed in a boiling alkali solution. In this latter step, the alkali reacts with the titanium nitride core, thereby causing its decomposition and concomitant leaching from the casted article.

As used herein, the term hollow article or body refers to any object cast from a molten alloy and having a cavity, passageway or other opening formed therein by proceeding in accordance with the present method. While metals and metal alloys in general, e.g., ferrous and titanium alloys as well as superalloys, can be used in the practice of the present method, it is particularly applicable to casting hollow articles from eutectic composition nickel base superalloys. It has been found that the titanium nitride core material used in the present method is non-reactive with eutectic alloys and is dimensionally stable when exposed to the high temperatures and long periods of time required in casting such alloys. In this regard it is noted that the melting point of titanium nitride at $1 \times 10^{-6}$ torr is $2950 \pm 50°$ C, a temperature considerably higher than that encountered in the casting operations. It is of particular significance that the titanium nitride core material can be readily removed from casted articles without damage thereto by leaching with boiling alkalis.

In one procedure for fabricating the core structures, the titanium nitride in powder form is compacted by uniaxially cold pressing (room temperature) in a steel die at a pressure ranging from about 2000 to 30,000 psi. Alternatively, the mixture can be isostatically cold pressed at a pressure ranging from about 5000 to 30,000 psi. The isostatic pressing is carried out by placing titanium nitride powder in a neoprene bag which is then subjected in a hydraulic cylinder to a pressure in the aforementioned range. It is often desirable to combine the two procedures, i.e., initially uniaxially cold pressing the powder followed by isostatically cold pressing the compacted powder.

In another procedure, the titanium nitride powder is mixed with an organic binder to provide a material having a paste-like consistency. Examples of binders that can be used include alcohols, such as ethanol, isopropanol and butanol, and hydrocarbons, such as benzene, toluene, xylene and cyclohexane. A body of any desired shape is then formed by subjectng the paste-like material to injection molding or slip casting in accordance with conventional practices. After the injection molding or slip casting operation, the molded or casted body is dried, e.g., by heating under a vacuum, e.g., $10^{-1}$ to $10^{-3}$ torr, at about 100 to 130° C for 12 to 48 hours. The body is then heated under a vacuum at a temperature ranging from about 400° to 500° C for a period of about 4 to 12 hours for the purpose of evaporating or burning off the organic binder contained in the body.

The body formed as described in the preceding paragraphs is then sintered. This is accomplished by heating the body under a vacuum, e.g., $1 \times 10^{-5}$ torr, at a temperature ranging from about 1500° to 1800° C for a period of about 1 to 4 hours or longer.

While the core body prepared as described above can be employed in carrying out the method of this invention, it is usually preferred to provide the body with a thin coating of yttrium oxide. To this end a thin layer of yttrium metal, e.g., about 4000 to 5000 angstroms thick, is coated on the body by vapor deposition. This is accomplished by heating the body under a vacuum and in the presence of yttrium at a temperature in the range of about 1450° to 1550° C for a period of about 1 to 3 hours. Thereafter, the body coated with yttrium is heated at about 600° to 800° C for about 1 to 3 hours in an oxidizing atmosphere, such as air, so as to convert the yttrium metal to yttrium oxide. The presence of the yttrium oxide coating provides several advantages. For example, it obviates the possibility of mechanical bonding between the core body and the metal alloy. Furthermore, the coating ensures that the core body will have a smooth surface that is free of pores.

In conducting the method of this invention, the core body having a desired geometry is positioned in a mold also having a desired geometry. It is to be understood that more than one core body can be disposed in a mold. For example, in casting a turbine blade from eutectic composition nickel base superalloys, a plurality of core bodies are positioned in a mold so as to provide air passages through the blade. The core bodies are disposed so that at least one end of each body is exposed when the casted article has cooled to room temperature and has been removed from the mold. The procedures followed in fabricating molds are well developed, and it is well within the skill of the art to fabricate a mold for forming an article having a desired shape. Examples of materials that can be used in making molds include yttria, alumina, fused silica, and the like.

After the molten metal alloy has been poured into the mold containing a core body formed of titanium nitride, the alloy is allowed to cool to room temperature. During this operation, which usually takes from about 12 to 36 hours, the mold is maintained under a vacuum, e.g., from $1 \times 10^{-5}$ to $1 \times 10^{-3}$ torr. The cooled, casted article with an end of the core body exposed is removed from the mold and immersed in a bath of a boiling alkali solution. It is usually preferred to utilize a boiling solution of potassium or sodium hydroxide. The concentration of alkali in the solution can vary within rather broad limits, e.g., from about 20 to 90 percent. The mold is allowed to remain in the solution for a period of time sufficient for the core body to be decomposed. The period of time required for the decomposition to occur depends upon several factors, e.g., the size and shape of the core body and the concentration of alkali, but it usually ranges from about 12 to 36 hours. Decomposition of the titanium nitride body takes place with the evolution of ammonia as shown by the following equation:

$$TiN + 6NaOH \xrightarrow[H_2O]{100^\circ C} NH_3 + TiO_3(H_2)_x + 3Na_2O$$

After decomposition of the core body is completed, the casted article is withdrawn from the bath and washed with water so as to remove all traces of alkali. The inner surface of the casted alloy presents a smooth finish, an indication that no chemical reaction occurs between the alloy and the titanium nitride core material .

A more complete understanding of the invention can be obtained by referring to the following illustrative example which is not intended, however, to be unduly limitative of the invention.

EXAMPLE

Fifteen grams of high purity (99.9+%) titanium nitride powder, obtained from a commercial source, was uniaxially cold pressed (room temperature) in a steel die at 3,000 psi. The compacted body was thereafter isostatically cold pressed at 30,000 psi. The body was then sintered by heating for 60 minutes at 1650° C under a vacuum of $1 \times 10^{31\ 5}$ torr. No appreciable dimensional changes were observed during sintering, and the golden yellow body obtained had a density of about 95% of theoretical (5.213 g/cm$^3$). The surface reflection X-ray diffraction pattern indicated titanium nitride, cubic structure a=4.245A. A 5000 angstrom thick yttrium layer was vapor deposited on the surface of the body and converted to yttrium oxide by oxidation at 700° C.

The titanium nitride core body prepared as described in the preceding paragraph was immersed in a molten nickel-based superalloy (NiTaC-13, General Electric) contained in a yttria crucible. The directionally solidified eutectic superalloy had the following composition:

| | Weight percent |
|---|---|
| C | 0.54 |
| Ta | 8.20 |
| W | 3.1 |
| Re | 6.2 |
| Al | 5.4 |
| V | 5.6 |
| Co | 3.2 |
| Cr | 4.4 |
| Ni | Balance |

The crucible containing the core material and the superalloy at a temperature of 1745° C was maintained under a vacuum of $1 \times 10^{-3}$ torr while cooling to room temperature over a period of about 15 hours. No visible chemical reactions occurred between the superalloy and the core material. The cooled casted superalloy with the coated titanium nitride core body exposed at one end was removed from the crucible and placed in a 50 percent boiling solution of potassium hydroxide. After 24 hours the titanium nitride core material had completely decomposed with the evolution of ammonia. After withdrawal from the solution and washing with water, examination of the casted article showed that its inner surface had a smooth finish. This indicated that no chemical reaction had occurred between the core material and the superalloy.

From the foregoing it is seen that the present invention provides a method for casting superalloys and directionally solidified eutectic superalloys whereby the titanium nitride core is readily removed by leaching with boiling alkalis without any delecterious effect on the microstructure of the casted alloy and without damage to its surface. Thus, the present method solves the problems of molten metal reactions with core materials, maintenance of dimensional stability during casting, avoidance of hot tearing of the casted alloys, and removal of core bodies from casted articles.

As will be evident to those skilled in the art, modifications of the present invention can be made in view of the foregoing disclosure without departing from the spirit and scope of the invention.

I claim:

1. A method for casting eutectic composition nickel base superalloys to form a hollow article which comprises introducing molten eutectic composition nickel base superalloy into a mold containing a core body fabricated from titanium nitride, the mold being maintained under a vacuum.

2. The method according to claim 1 in which the titanium nitride core body is coated with a layer of yttrium oxide.

3. The method according to claim 2 in which the layer of yttrium oxide has a thickness of about 4000 to 5000 angstroms.

4. The method according to claim 2 in which the mold is maintained under a vacuum of $1 \times 10^{-5}$ to $1 \times 10^{-3}$ torr.

5. The method according to claim 4 in which the mold is cooled to room temperature over a period of about 12 to 36 hours; a casted article with an end of the core body exposed is removed from the mold; and the casted article is immersed in a boiling alkali solution.

6. The method according to claim 5 in which the concentration of alkali in the solution ranges from about 20 to 90 percent; and the casted article is immersed in the solution for a period of about 12 to 36 hours.

7. The method according to claim 6 in which the alkali is potassium hydroxide or sodium hydroxide.

8. A method for casting euteetic composition nickel base superalloys to form a hollow article which comprises the following steps:

a. positioning in a mold a core body fabricated from titanium nitride and coated with yttrium oxide, the core body being diposed in the mold so that an end of the body is exposed when the casted article has cooled to room temperature and has been removed from the mold as recited in steps (c) and (d);
b. introducing molten eutectic composition nickel base superalloy into the mold while maintaining the mold under a vacuum;
c. allowing the mold to cool to room temperature while maintaining the mold under a vacuum;
d. removing the casted article from the mold with an end of the core body exposed;
e. immersing the casted article in a boiling alkali solution, thereby causing decomposition of the core body;
f. withdrawing the casted article from the solution; and
g. washing the casted article with water, thereby removing all traces of alkali and providing a hollow article having a smooth inner surface.

9. The method according to claim 8 in which the core body is fabricated by (1) uniaxially cold pressing titanium nitride in powder form in a steel die at a pressure ranging from about 2000 to 30,000 psi; (2) sintering the resulting compacted body by heating it under a vacuum at a temperature ranging from about 1500° to 1800° C for a period of about 1 to 4 hours; (3) heating the sintered body under a vacuum and in the presence of yttrium at a temperature in the range of about 1450° to 1550° C for a period of about 1 to 3 hours; and (4) heating the body coated with yttrium at a temperature ranging from about 600° to 800° C for about 1 to 3 hours in an oxidizing atmosphere, thereby converting the yttrium metal to yttrium oxide.

10. The method according to claim 8 in which the core body is fabricated by (1) isostatically cold pressing titanium nitride in powder form at a pressure ranging from about 5000 to 30,000 psi; (2) sintering the resulting compacted body by heating it under a vacuum at a temperature ranging from about 1500° to 1800° C for a period of about 1 to 4 hours; (3) heating the sintered body under a vacuum and in the presence of yttrium at a temperature in the range of about 1450° to 1550° C; and (4) heating the body coated with yttrium at a temperature ranging from about 600° to 800° C for about 1 to 3 hours in an oxidizing atmosphere, thereby converting the yttrium metal to yttrium oxide.

11. The method according to claim 8 in which the core body is fabricated by (1) uniaxially cold pressing titanium nitride in powder form in a steel die at a pressure ranging from about 2000 to 30,000 psi; (2) isostatically cold pressing the uniaxially cold pressed body at a pressure ranging from about 5000 to 30,000 psi; (3) sintering the resulting compacted body by heating it under a vacuum at a temperature ranging from about 1500° to 1800° C for a period of about 1 to 4 hours; (4) heating the sntered body under a vacuum and in the presence of yttrium at a temperature in the range of 1450° to 1550° C for a period of about 1 to 3 hours; and (5) heating the body coated with yttrium at a temperature ranging from about 600° to 800° C for about 1 to 3hours in an oxidizing atmosphere, thereby converting the yttrium metal to yttrium oxide.

* * * * *